US008111197B2

(12) United States Patent
Noro et al.

(10) Patent No.: US 8,111,197 B2
(45) Date of Patent: Feb. 7, 2012

(54) ANTENNA APPARATUS

(75) Inventors: Junichi Noro, Akita (JP); Kazunari Saito, Akita (JP); Akira Miyoshi, Sagamihara (JP); Hiroshi Suzuki, Akita (JP)

(73) Assignee: Mitsumi Electric Co., Ltd., Tama-Shi (JP)

( * ) Notice: Subject to any disclaimer, the term of this patent is extended or adjusted under 35 U.S.C. 154(b) by 472 days.

(21) Appl. No.: 12/427,874

(22) Filed: Apr. 22, 2009

(65) Prior Publication Data

US 2010/0156724 A1 Jun. 24, 2010

(30) Foreign Application Priority Data

Dec. 18, 2008 (JP) ..... 2008-322030

(51) Int. Cl.
*H01Q 1/38* (2006.01)

(52) U.S. Cl. ..... 343/700 MS; 343/846

(58) Field of Classification Search ..... 343/700 MS, 343/846, 848
See application file for complete search history.

(56) References Cited

U.S. PATENT DOCUMENTS

| | | | | |
|---|---|---|---|---|
| 6,452,548 | B2 | 9/2002 | Nagumo et al. | |
| 6,577,208 | B2 | 6/2003 | Kushitani et al. | |
| 7,079,084 | B2 | 7/2006 | Notohara et al. | |
| 7,129,906 | B2 | 10/2006 | Yoneya et al. | |
| 7,893,879 | B2 * | 2/2011 | Noro et al. | 343/700 MS |
| 2006/0049987 | A1 | 3/2006 | Herrick | |
| 2007/0205945 | A1 | 9/2007 | Tatarnikov et al. | |
| 2008/0074327 | A1 | 3/2008 | Noro et al. | |
| 2008/0198086 | A1 | 8/2008 | Coupez et al. | |

FOREIGN PATENT DOCUMENTS

| | | | |
|---|---|---|---|
| EP | 1 684 381 | B1 | 10/2008 |
| FR | 2 710 195 | A1 | 3/1995 |
| JP | 09-083239 | A | 3/1997 |
| JP | 2001-217643 | A | 8/2001 |
| JP | 2002-252534 | A | 9/2002 |
| JP | 2004-236273 | A | 8/2004 |
| JP | 2005-109688 | A | 4/2005 |
| JP | 2006-332784 | A | 12/2006 |

OTHER PUBLICATIONS

German Office Action dated Aug. 7, 2009 (3 pages), and English translation thereof (2 pages), issued in counterpart German Application Serial No. 10 2009 018 834.7-55. Jang, Yon-Jeong, et al., "The Miniaturized Microstrip Antenna with 'L' type Plates," 18th Intl. Conference on Applied Electromagnetics and Communications, pp. 1-4, Oct. 12-14, 2005.
Seo, J-S, et al., "Miniaturization of microstrip antenna using irises," Electronics Letters, vol. 40, No. 12, pp. 718-719, Jun. 10, 2004.
Japanese Office Action dated Feb. 22, 2011 (and English translation thereof) in counterpart Japanese Application No. 2008-322030.
Japanese Office Action dated Oct. 12, 2010 (and English translation thereof) in counterpart Japanese Application No. 2008-322030.
German Office Action dated Feb. 11, 2010 and English translation thereof issued in a counterpart German Application No. 10 2009 018 834.7-55.

* cited by examiner

*Primary Examiner* — Michael C Wimer
(74) *Attorney, Agent, or Firm* — Holtz, Holtz, Goodman & Chick, PC

(57) ABSTRACT

Disclosed is an antenna apparatus, including: a multi-layer substrate having at least two substrates in a stacking manner and having a first through hole; an amplifying circuit on one face of the multi-layer substrate; a ground pattern formed between two adjacent substrates of the multi-layer substrate; an antenna pattern formed on the other face of the multi-layer substrate; and a first comb electrode having comb teeth and a second comb electrode having comb teeth, both of which are formed around the antenna pattern on the other face of the multi-layer substrate. The first comb electrode is electrically connected to the antenna pattern. The second comb electrode is electrically connected to the ground pattern through the first through hole. The comb teeth of the first comb electrode and the comb teeth of the second comb electrode are spaced from one another at predetermined intervals in a staggered manner.

4 Claims, 6 Drawing Sheets

ANTENNA APPARATUS

BACKGROUND OF THE INVENTION

1. Field of the Invention

The present invention relates to an antenna apparatus.

2. Description of Related Art

In recent years, an antenna apparatus of an in-vehicle GPS system which is widely spread as a positioning system, and an antenna apparatus of a home use satellite radio or an in-vehicle satellite radio or the like which is put to practical use in the United States, have been developed progressively. Such a conventional antenna apparatus has a structure shown in FIG. 6, for example (see Japanese Parent Application Laid-open No. 2005-109688).

As shown in FIG. 6, the conventional antenna apparatus 100 includes an antenna element 102 made of ceramic for receiving a radio wave and a circuit substrate 103 which is stuck to a back face of the antenna element 102. An amplifying circuit (not shown) for amplifying an input from the antenna element 102 is formed on a face of the circuit substrate 103 on the opposite side of the antenna element 102. The face on which the amplifying circuit is formed is covered by a shield cover 104 having an approximately box-shaped body. The circuit substrate 103 and the antenna element 102 adhere to one another with a double-sided tape (not shown). A power supply pin 106, which passes through the circuit substrate 103 and the antenna element 102, is fixed to the circuit substrate 103 and the antenna element 102. A tip end portion of the power supply pin 106 is soldered to the amplifying circuit on the circuit substrate 103 to achieve an electrical connection. Accordingly, a radio wave signal received by the antenna element 102 is inputted to the amplifying circuit via the power supply pin 106.

As with the other electronic parts, it is hoped that antenna apparatuses will be thinner. It is also hoped that the cost of parts and the assembling cost will be reduced by reducing the number of parts to achieve reduction of manufacturing cost.

SUMMARY OF THE INVENTION

It is, therefore, a main object of the present invention to provide a thin antenna apparatus with a small number of parts.

According to a first aspect of the present invention, there is provided an antenna apparatus, including: a multi-layer substrate having at least two substrates in a stacking manner and having a first through hole passing through at least one of the substrates; an amplifying circuit formed on one face of the multi-layer substrate; a ground pattern which is made of a metal film and which is formed between two adjacent substrates of the multi-layer substrate; an antenna pattern which is made of a metal film and which is formed on the other face of the multi-layer substrate; a first comb electrode formed around the antenna pattern on the other face of the multi-layer substrate, the first comb electrode, which has comb teeth and is made of a metallic film, being electrically connected to the antenna pattern; and a second comb electrode formed around the antenna pattern on the other face of the multi-layer substrate, the second comb electrode, which has comb teeth, being electrically connected to the ground pattern through the first through hole, wherein the comb teeth of the first comb electrode and the comb teeth of the second comb electrode are spaced from one another at predetermined intervals in a staggered mariner.

According to a second aspect of the present invention, there is provided an antenna apparatus, including: a multi-layer substrate having at least a top layer substrate, an intermediate layer substrate, and a bottom layer substrate in a stacking manner and having a first through hole passing through the top layer substrate, and having a second through hole passing through the intermediate layer substrate; an amplifying circuit formed on the bottom layer substrate; a ground pattern formed on one face of the intermediate layer substrate; an antenna pattern, formed on the top layer substrate; a first comb electrode which is formed on the other face of the intermediate layer substrate so that the first comb electrode and the antenna pattern stack with one another, and which has comb teeth and is made of a metallic film and is electrically connected to the antenna pattern through the first through hole; and a second comb electrode which is formed on the other face of the intermediate layer substrate so that the second comb electrode and the antenna pattern stack with one another, and which has comb teeth and is made of a metal lie film and is electrically connected to the ground pattern through the second through hole, wherein the comb teeth of the first comb electrode and the comb teeth of the second comb electrode are spaced from one another at predetermined intervals in a staggered manner.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

An antenna apparatus of preferred embodiments of the present invention will be explained below with reference to the drawings.

Figure 1:
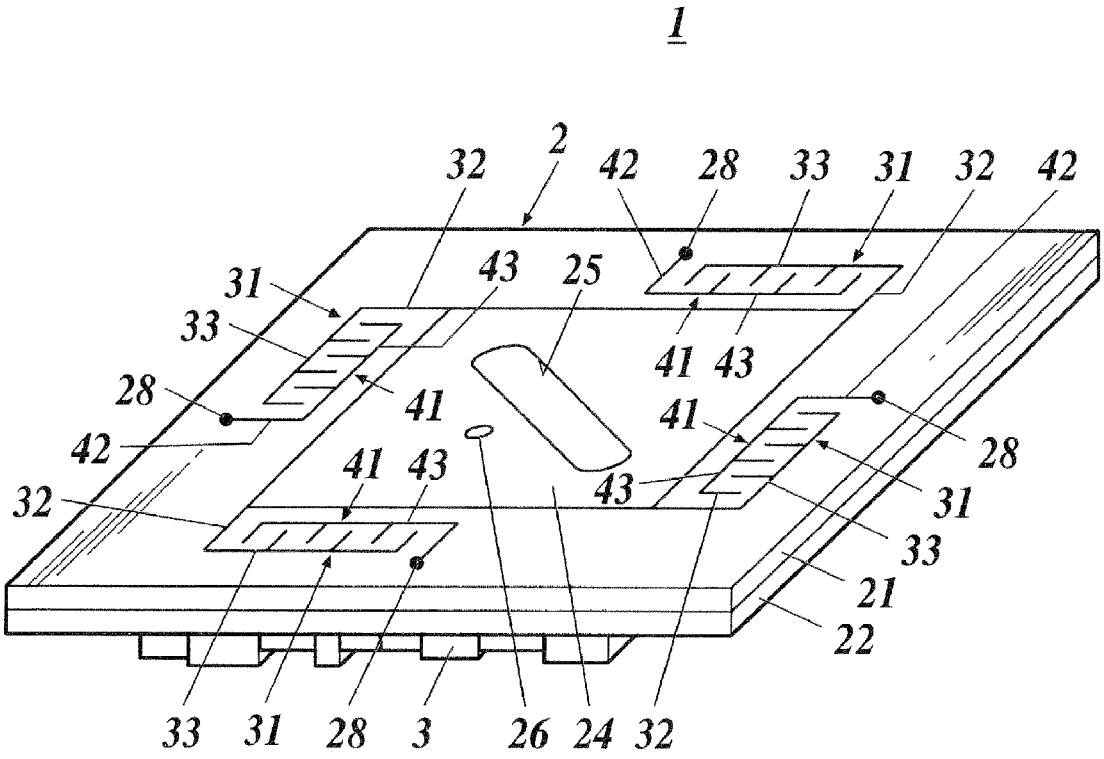
FIG. 1 is a schematic perspective view of an antenna apparatus according to preferred embodiments of the present invention.
Figure 2:
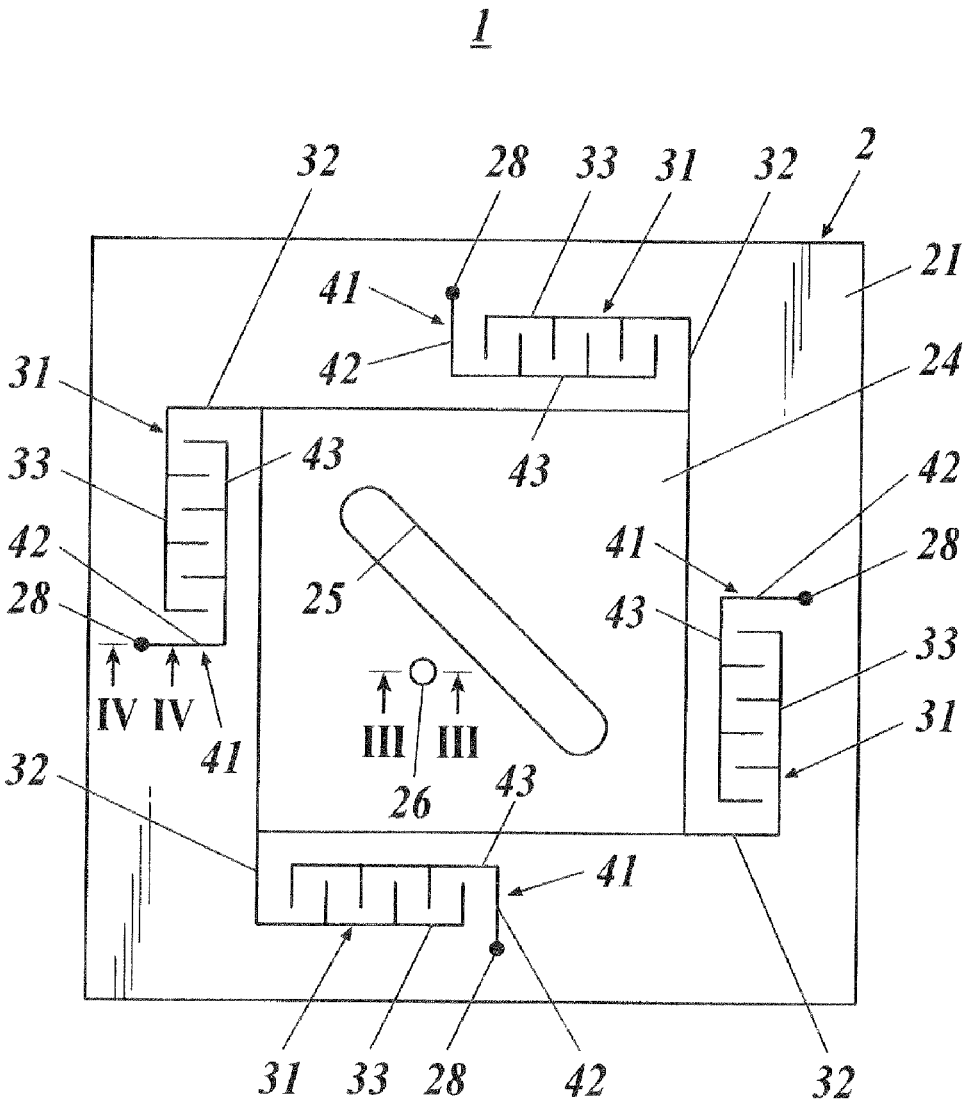
FIG. 2 is a schematic top view of the antenna apparatus.

FIG. 1 is a schematic perspective view of the antenna apparatus. FIG. 2 is a top view of the antenna apparatus. As shown in FIG. 1 and FIG. 2, the antenna apparatus 1 includes a multi-layer substrate 2 and an amplifying circuit 3 which is provided on a lower face (one face) of the multi-layer substrate 2.

Two substrates 21 and 22, which are made of glass-epoxy material, are stacked to form the multi-layer substrate 2. A ground pattern 23 made of a metal film is formed between the substrates 21 and 22 (see FIG. 3 and FIG. 4). An antenna pattern. 24 made of a metal film is formed on an upper face (the other face) of the multi-layer substrate 2, namely, on a surface of the substrate 21. The antenna pattern. 24 constitutes a receiving face for receiving a radio wave. The external shape of the antenna pattern 24 is a quadrangle when viewed from the top. An opening portion 25 as a long hole is formed in a central, portion of the antenna pattern 24 to expose a face of the substrate 21. The external shape of the antenna pattern 24 or the opening portion 25 depends on the frequency of the radio wave to be received by the antenna apparatus 1. A through hole (a second through hole) 26 is formed in the vicinity of the opening portion 25 in the antenna pattern 24.

Figure 3:
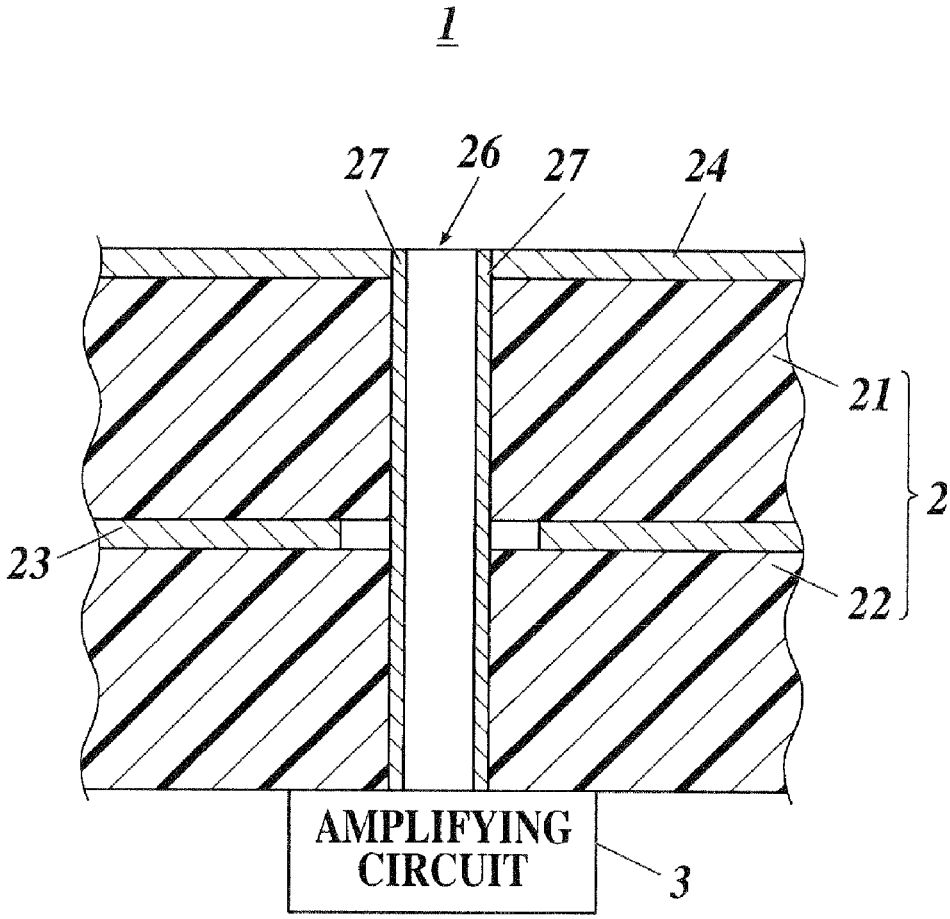
FIG. 3 is a cross sectional view taken from line III-III of FIG. 2.

FIG. 3 is a cross sectional view taken from line III-III of FIG. 2 and shows a schematic structure of the through hole 26. As shown in FIG. 3, the through hole 26 penetrates the substrates 21 and 22. An inner circumference face of the through hole 26 is covered by a metallic film 27. The metallic film 27 is connected to the amplifying circuit 3 and the antenna pattern 24. Accordingly, the antenna pattern 24 and the amplifying circuit 3 are electrically connected via the through hole 26. The ground pattern 23 has no contact with the metallic film 27 of the through hole 26.

A plurality of first comb electrodes 31 made of a metallic film are formed around the antenna pattern 24 on the upper face of the multi-layer substrate 2, and are electrically connected to the antenna pattern 24. Each of the first, comb electrodes 31 includes a base line portion 32 which is led to the antenna pattern 24 and comb teeth 33 which are led from an end of the case line portion 32.

A plurality of second comb electrodes 41 are formed around the antenna pattern 24 on the upper face of the multi-layer substrate 2 as counterparts of the first comb electrodes 31. Each of the second comb electrodes 41 includes a base line portion 42 which is led to a through hole (a first through hole) 28 formed in the multi-layer substrate 2 and comb teeth 43 which are led from an end of the base line portion 42. The comb teeth 43 of the second comb electrode 41 are spaced from the comb teeth 33 of the first comb electrode 31 at predetermined intervals in a staggered manner.

Figure 4:
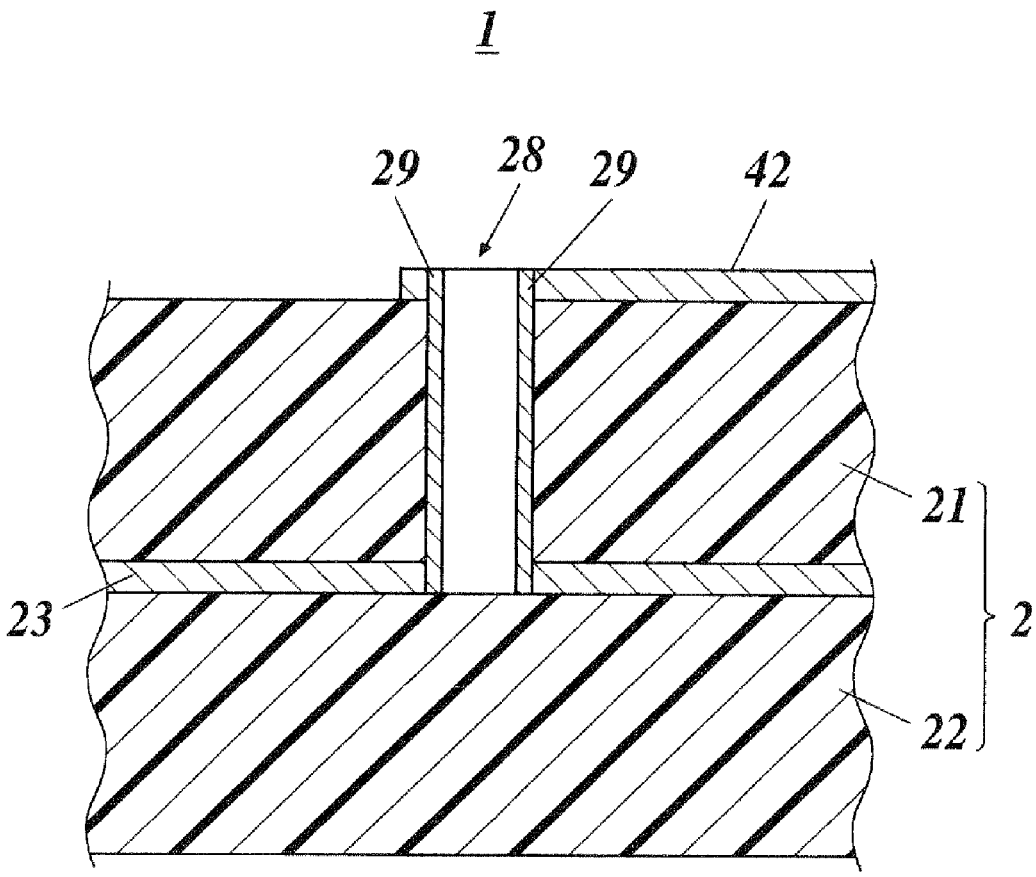
FIG. 4 is a cross sectional view taken from line IV-IV of FIG. 2.

FIG. 4 is a cross sectional view taken from line IV-IV of FIG. 2 and shows a schematic structure of the through hole 28. As shown in FIG. 4, the through hole 28 passes through the substrate 21. An inner circumference face of the through hole 28 is covered by a metallic film 29. The metallic film 29 is connected to the ground pattern 23 and the base line portion 42 of the second comb electrode 41. Accordingly, the second comb electrode 41 is electrically connected to the ground pattern 23 via the through hole 28.

Next, the operation of the antenna apparatus 1 will be explained.

When the radio wave is received by the antenna pattern 24, the radio wave signal is transmitted to the amplifying circuit 3 via the metallic film 27 of the through hole 26. The radio wave signal is amplified by the amplifying circuit 3 and the amplified signal is outputted to an external device. As described above, the comb teeth 33 of the first comb electrode 31 and the comb teeth 43 of the second comb electrode 41 are spaced from one another at predetermined intervals in a staggered manner. With this structure, at the time of receiving the radio wave, the first comb electrode 31 and the second comb electrode 41 function as capacitors to achieve a radiation pattern having capacitance.

According to this embodiment, because the antenna pattern 24 made of a metallic film is formed on the multi-layer substrate 2, the entire multi-layer substrate 2 can function as an antenna element. Because the antenna element formed of the multi-layer substrate 2 is thinner than a conventional antenna element which is made of ceramic, it is possible to achieve a thin antenna apparatus 1 as a whole.

Further, the first comb electrodes 31, which are electrically connected to the antenna pattern 24, and the second comb electrodes 41 are arranged around the antenna pattern 24. With this structure, the first comb electrode 31 and the second comb electrode 41 function as capacitors to achieve a radiation pattern having capacitance. Consequently, it is possible to provide the antenna apparatus 1 whose radiation pattern is the same as that of the conventional antenna element and whose surface area is small.

In the conventional antenna apparatus, an antenna element and a circuit substrate are provided as separate bodies, and both are fixed with a double-sided tape. In this embodiment, because the multi-layer substrate 2 itself is an antenna element, the double-sided tape is not needed any more.

With this, it is possible to provide the thin antenna apparatus 1 with a small number of parts.

Further, the antenna pattern 24 and the amplifying circuit 3 are electrically connected via the through hole 26 in the multi-layer substrate 2. This structure makes it possible to achieve the electrical connection between the antenna pattern 24 and the amplifying circuit 3 without a power supply pin which was one of the necessary parts of the conventional antenna apparatus. Therefore, an antenna apparatus with a small number of parts can be accomplished.

The present invention is not limited to the above-described embodiment. Various modifications can be made without departing from the scope of the invention.

The same reference number will be used below to refer to the same parts of the above-described embodiment without adding explanation.

In the above-described embodiment, four combinations of the first comb electrode 31 and the second comb electrode 41 are disposed for each side of the antenna pattern 24. It will be apparent to those skilled in the art that more than four combinations of the first comb electrode 31 and the second comb electrode 41 can be employed. It should be noted that four combinations of the first comb electrode 31 and the second comb electrode 41 are preferable because frequency can easily be adjusted.

The multi-layer substrate 2 is formed of glass-epoxy substrates in the above-described embodiment. Other material whose permittivity is smaller than that of ceramic may be employed as a material of the multi-layer substrate 2.

Figure 5:
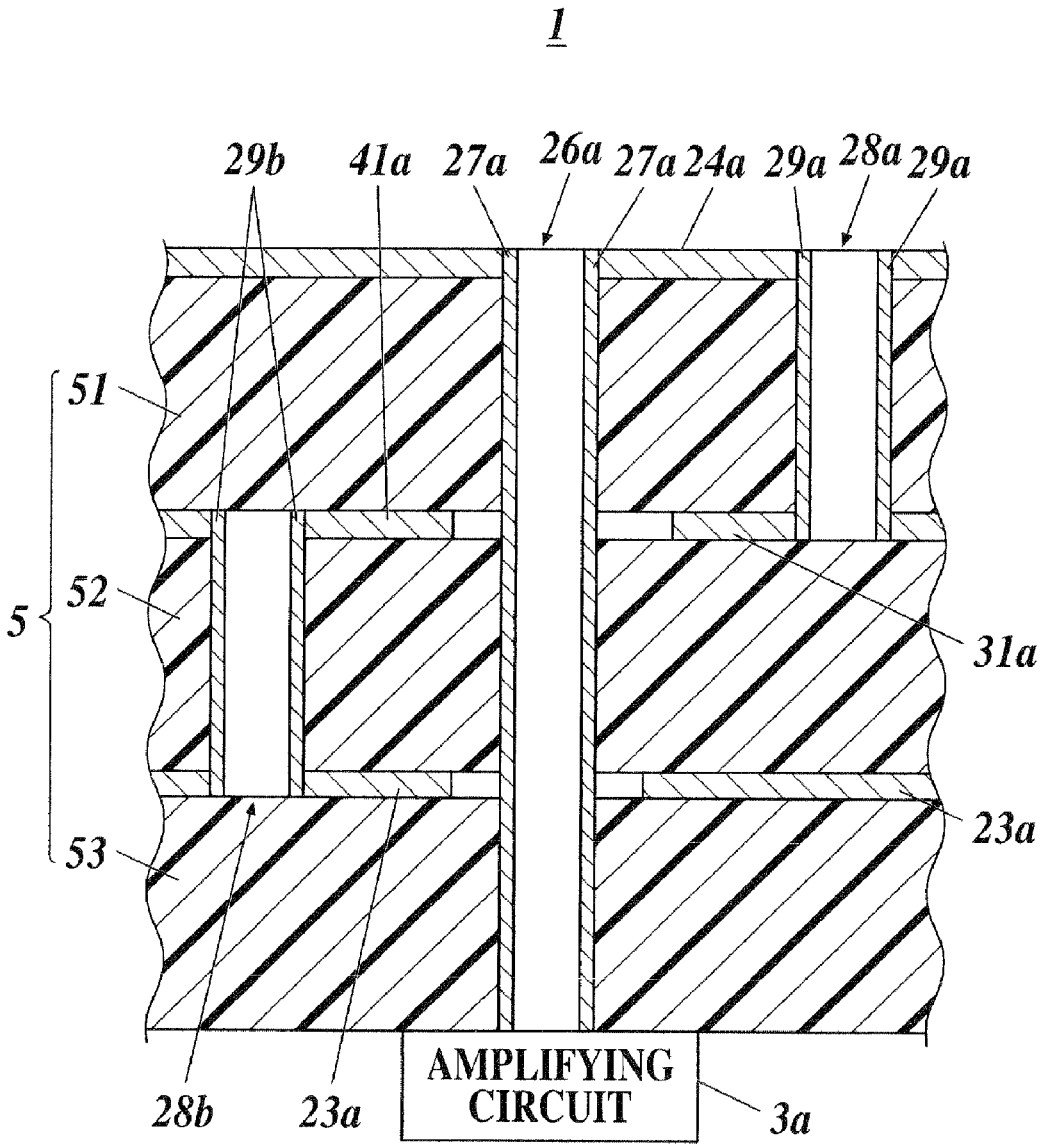
FIG. 5 is a schematic cross sectional view of an antenna apparatus according to a modification of the embodiments.
Figure 6:
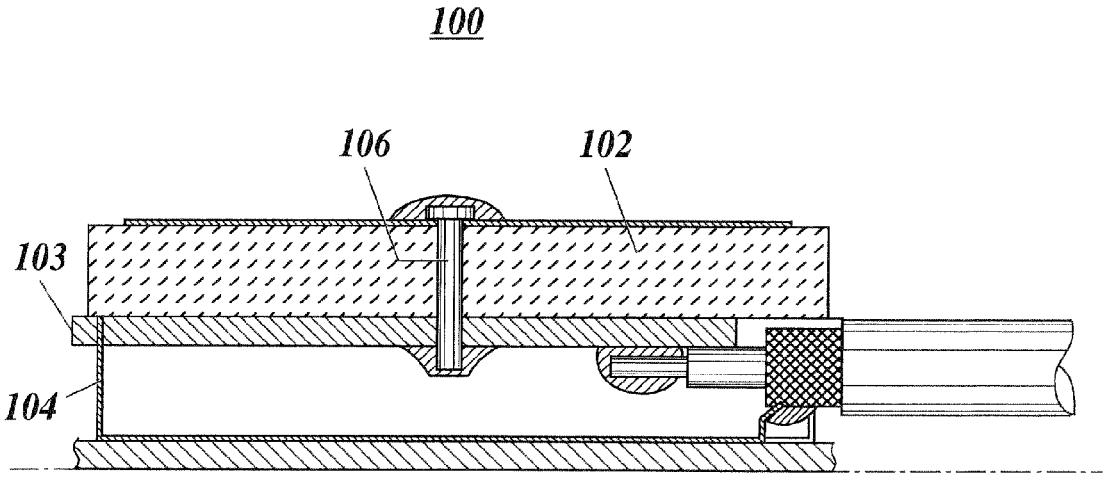
FIG. 6 shows a schematic cross-sectional view of a conventional antenna apparatus.

Further, the multi-layer substrate 2 includes two substrates 21 and 22 in the above-described embodiment. Three or more substrates may constitute the multi-layer substrate. In this case, the first comb electrode and the second comb electrode can be formed at an interlayer which is different from an interlayer for the ground pattern. Specifically, an antenna apparatus 1A shown in FIG. 5 includes a multi-layer substrate 5 having three substrates 51, 52 and 53 which are made of glass-epoxy.

In antenna pattern 24*a* is formed on a face of the substrate 51 as a top layer. An amplifying circuit 3*a* is disposed on a face of the substrate 53 as a bottom layer. A first comb elect rode 31*a* and a second comb electrode 41*a* are disposed between the substrate 51 and the intermediate substrate 52. A ground pattern 23*a* is disposed between the intermediate substrate 52 and the substrate 53.

The multi-layer substrate 5 includes a through hole 26*a* which penetrates the substrates 51, 52 and 53, a through hole 28*a* which penetrates the substrate 51, and a through hole 28*b* which penetrates the substrate 52.

An inner circumference face of the through hole 26*a* is covered by a metallic film 27*a*. The metallic film 27*a* is connected to the amplifying circuit 3*a* and the antenna pattern 24*a*. Accordingly, the antenna pattern 24*a* and the amplifying circuit 3*a* are electrically connected via the through hole 26*a*. Here, also in this case, the ground pattern 23*a* has no contact with the metallic film 27*a* of the through hole 26*a*.

An inner circumference face of the through hole 28*a* is covered by a metallic film 29*a*. The metallic film 29*a* is connected to the first comb electrode 31*a* and the antenna pattern 24*a*. Accordingly, the first, comb electrode 31*a* and the antenna pattern 24*a* are electrically connected via the through hole 28*a*.

An inner circumference face of the through hole 28*b* is covered by a metallic film 29*b*. The metallic film 29*b* is connected to the ground pattern 23*a* and the second comb electrode 41*a*. Accordingly, the second comb electrode 41*a* and the ground pattern 23*a* are electrically connected via the through hole 28*b*.

According to the antenna apparatus 1A, because the first comb electrode 31*a* and the second comb electrode 41*a* are formed at the interlayer which is different from the interlayer for the ground pattern 23*a*, the first comb electrode 31*a* and the second comb electrode 41*a* can be arranged below the antenna pattern 24*a*. With this structure, a surface area of the antenna apparatus 1A can be smaller than that of an antenna apparatus in which the first comb electrode and the second comb electrode are formed around the antenna pattern 24*a*.

According to a first aspect of the preferred embodiments of the present invention, there is provided an antenna apparatus, including: a multi-layer substrate having at least two substrates in a stacking mariner and having a first through hole passing through at least one of the substrates; an amplifying circuit formed on one face of the multi-layer substrate; a ground pattern which is made of a metal film and which is formed between two adjacent substrates of the multi-layer substrate; an antenna pattern which is made of a metal film and which is formed on the other face of the multi-layer substrate; a first comb electrode formed around the antenna pattern on the other face of the multi-layer substrate, the first comb electrode, which has comb teeth and is made of a metallic film, being electrically connected to the antenna pattern; and a second comb electrode formed around the antenna pattern on the other face of the multi-layer substrate, the second comb electrode, which has comb teeth, being electrically connected to the ground pattern through the first through hole, wherein the comb teeth of the first comb electrode and the comb teeth of the second comb electrode are spaced from one another at predetermined intervals in a staggered manner.

Preferably, the multi-layer substrate further has a second through hole through which the antenna pattern is electrically connected to the amplifying circuit.

Preferably, the multi-layer substrate is formed of glass-epoxy substrates.

According to a second aspect of the preferred embodiments of the present invention, there is provided an antenna apparatus, including: a multi-layer substrate having at least a top layer substrate, an intermediate layer substrate, and a bottom layer substrate in a stacking manner and having a first through hole passing through the top layer substrate, and having a second through hole passing through the intermediate layer substrate; an amplifying circuit formed, on the bottom layer substrate; a ground pattern formed on one face of the intermediate layer substrate; an antenna pattern formed on the top layer substrate; a first comb electrode which is formed on the other face of the intermediate layer substrate so that the first comb electrode and the antenna pattern stack with one another, and which has comb teeth and is made of a metallic film and is electrically connected to the antenna, pattern through the first through hole; and a second comb electrode which is formed on the other face of the intermediate layer substrate so that the second comb electrode and the antenna pattern stack with one another, and which has comb teeth and is made of a metallic film and is electrically connected to the ground pattern through the second through hole, wherein the comb teeth of the first comb electrode and the comb teeth of the second comb electrode are spaced from one another at predetermined intervals in a staggered manner.

Because the multi-layer substrate having at least two glass-epoxy substrates has a dielectric constant er of 4 to 5, the multi-layer substrate can function as an antenna element as a whole if the antenna pattern made of a metal film is formed on the multi-layer substrate. Because the antenna element formed of the multi-layer substrate is thinner than a conventional antenna element which is made of ceramic, it is possible to achieve a thin antenna apparatus as a whole.

However, the dielectric constant of the multi-layer substrate is drastically smaller than that of the conventional ceramic antenna element. Therefore, a surface area of the multi-layer substrate must be large in order to obtain the same radiation pattern as that of the conventional antenna element.

To avoid this drawback, in the preferred embodiment of the present invention, tine comb teeth of the first comb electrode and the comb teeth of the second comb electrode are spaced from one another at predetermined intervals in a staggered manner around the antenna pattern. With this structure, the first comb electrode and the second comb electrode function as capacitors to achieve a radiation pattern having capacitance. Consequently, it is possible to provide an antenna apparatus whose radiation pattern is the same as that of the conventional antenna element and whose surface area is small.

In the conventional antenna apparatus, an antenna element and a circuit substrate are provided as separate bodies, and both are fixed with a double-sided tape. In the preferred embodiment of the present invention, because the multi-layer substrate itself is an antenna element, the double-sided tape is not needed, any more.

With this, it is possible to provide a thin antenna apparatus with a small number of parts.

The entire disclosure of Japanese Patent Application No. 2008-322030 filed on Dec. 18, 2008 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. An antenna apparatus, comprising:

a multi-layer substrate having at least two substrates in a stacking manner and having a first through hole passing through at least one of the substrates;

an amplifying circuit formed on one face of the multi-layer substrate;

a ground pattern which is made of a metal film and which is formed between two adjacent substrates of the multi-layer substrate;

an antenna pattern which is made of a metal film and which is formed on the other face of the multi-layer substrate;

a first comb electrode formed around the antenna pattern on the other face of the multi-layer substrate, the first comb electrode, which has comb teeth and is made of a metallic film, being electrically connected to the antenna pattern; and a second comb electrode formed around the antenna pattern on the other face of the multi-layer substrate, the second comb electrode, which has comb teeth, being electrically connected to the ground pattern through the first through hole, wherein the comb teeth of the first comb electrode and the comb teeth of the second comb electrode are spaced from one another at predetermined intervals in a staggered manner.

2. The antenna apparatus according to claim 1, wherein the multi-layer substrate further has a second through hole through which the antenna pattern is electrically connected to the amplifying circuit.

3. The antenna apparatus according to claim 1, wherein the multi-layer substrate is formed of glass-epoxy substrates.

4. An antenna apparatus, comprising:

a multi-layer substrate having at least a top layer substrate, an intermediate layer substrate, and a bottom layer substrate in a stacking manner and having a first through hole passing through the top layer substrate, and having a second through hole passing through the intermediate layer substrate;

an amplifying circuit formed on the bottom layer substrate;

a ground pattern formed on one face of the intermediate layer substrate;

an antenna pattern formed on the top layer substrate;

a first comb electrode which is formed on the other face of the intermediate layer substrate so that the first comb electrode and the antenna pattern stack with one another, and which has comb teeth and is made of a metallic film and is electrically connected to the antenna pattern through the first through hole; and a second comb electrode which is formed on the other face of the intermediate layer substrate so that the second comb electrode and the antenna pattern stack with one another, and which has comb teeth and is made of a metallic film and is electrically connected to the ground pattern through the second through hole, wherein the comb teeth of the first comb electrode and the comb teeth of the second comb electrode are spaced from one another at predetermined intervals in a staggered manner.

* * * * *